United States Patent [19]

McWaters

[11] Patent Number: 4,689,030

[45] Date of Patent: Aug. 25, 1987

[54] HYDROTHERAPY VEST

[76] Inventor: James G. McWaters, 5074 Shelby Dr., Birmingham, Ala. 35243

[21] Appl. No.: 776,688

[22] Filed: Sep. 16, 1985

[51] Int. Cl.[4] ..... B63C 9/08

[52] U.S. Cl. ..... 441/88; 441/106; 434/254; D21/238

[58] Field of Search ..... 441/88, 106, 108, 110–121, 441/136, 129; 434/262, 247, 254; D21/236, 237, 238

[56] References Cited

U.S. PATENT DOCUMENTS

| | | | |
|---|---|---|---|
| 1,291,448 | 1/1919 | Edmonds | 441/115 |
| 2,066,725 | 1/1937 | Gammaitoni | 441/114 |
| 3,261,042 | 7/1966 | Baker | D21/238 X |
| 3,266,069 | 8/1966 | O'Link | 441/108 X |
| 3,646,626 | 3/1972 | Frieder | 441/115 |
| 4,047,255 | 9/1977 | Kiefer | 441/111 X |
| 4,443,204 | 4/1984 | Perrin | 441/129 |
| 4,551,108 | 11/1985 | Bass | 441/116 |

FOREIGN PATENT DOCUMENTS

| | | | |
|---|---|---|---|
| 1137014 | 1/1985 | U.S.S.R. | 441/106 |

*Primary Examiner*—Joseph F. Peters, Jr.
*Assistant Examiner*—Paul E. Salmon

[57] ABSTRACT

A flotation device for athletic training or for hydrotherapy utilizes a vest-like member which encases buoyant members of unequal buoyancy such that a wearer is supported in water in an upright position, yet inclined slightly forward, and immersed above the shoulders. The vest is fitted to the wearer by adjustment and retaining straps and provides complete unhampered freedom of movement of the appendages whereby the user may exercise using the same biomechanical motions involved in a like exercise performed out of the water.

14 Claims, 3 Drawing Figures

HYDROTHERAPY VEST

FIELD OF THE INVENTION

The present invention relates to the field of hydrotherapy or aquatic conditioning in general and more particularly relates to a means for utilizing water as a restrictive medium in which to perform conditioning exercises or other training. In even greater particularity the present invention may be described as a flotation vest which holds the user in a generally upright and forwardly inclined posture and supports him at neck level to enable the user to exercise his limbs when immersed in water without contact with the ground or floor.

BACKGROUND OF THE INVENTION

Water provides greater resistance to movement of the appendages than does air, consequently, it has been accepted that swimming and other water sports in which a portion of the body is immersed in the water are quite useful in conditioning muscles. However, muscles develop specifically in the way in which they are trained. That is, muscular development generated by swimming or such alternatives as cycling and weight training are good secondary methods of overall conditioning for people who are not engaged in cycling, swimming or weight training as their primary sport or activity; however they do not lead to the direct development of the muscles required for other activities. Thus it should be seen that for proper training the athlete or patient, as the case may be, should utilize the correct biomechanical movements in order to properly develop his musculature. That is to say, for example, the person should engage not in swimming but rather in running immersed in and buoyed by water in order to strengthen the muscles desired for running.

Unfortunately flotation devices developed heretofore have not been designed to allow the user to perform such exercises but rather have been designed for safety purposes. The ski vests and life jackets which are used for flotation by most people are designed to keep the upper body well out of the water and to force the wearer onto his or her back to prevent drowning. Consequently such devices support the wearer in what would be an unnatural position for repetitive exercises such as running or aerobics, which will also be referred to as "running activities". Also, such devices are not designed to allow the freedom of movement associated with proper running or aerobic exercises. As a result of these shortcomings, a person attempting to use a standard ski vest or life jacket to condition himself through performing his normal exercise routine in water will find that he is utilizing muscles in a manner not normally utilized in his particular sport due to the improper positioning afforded by these flotation devices and is likely to experience at least some discomfort due to the bulkiness of such devices. Furthermore, since these devices are designed to hold the wearer substantially out of the water, the upper extremities, that is the arms and shoulders of the wearer, are generally held above the water and do not benefit greatly from the increased resistance afforded to the wearer by the water.

SUMMARY OF THE INVENTION

It is the object of the present invention to provide a flotation device which will support a wearer in water in such a manner that he may perform running or other exercises in a manner which allows the exact duplication of the primary exercise.

Yet another object of the invention is to provide improved athletic form by practice of correct biomechanical movements in an environment which provides increased resistance to such movements.

Yet another object of the invention is to provide intense training with less risk of injury in less time.

Yet another object of the invention is to provide a means of exercise for the elderly, handicapped, or arthritic which allows a full range of motion, yet which provides substantial resistance and is not likely to cause injury or discomfort.

Yet another object of the invention is to provide injured athletes or performers the ability to continue in training and rehearsal while aiding recovery.

DESCRIPTION OF THE PREFERRED EMBODIMENT

Figure 1:
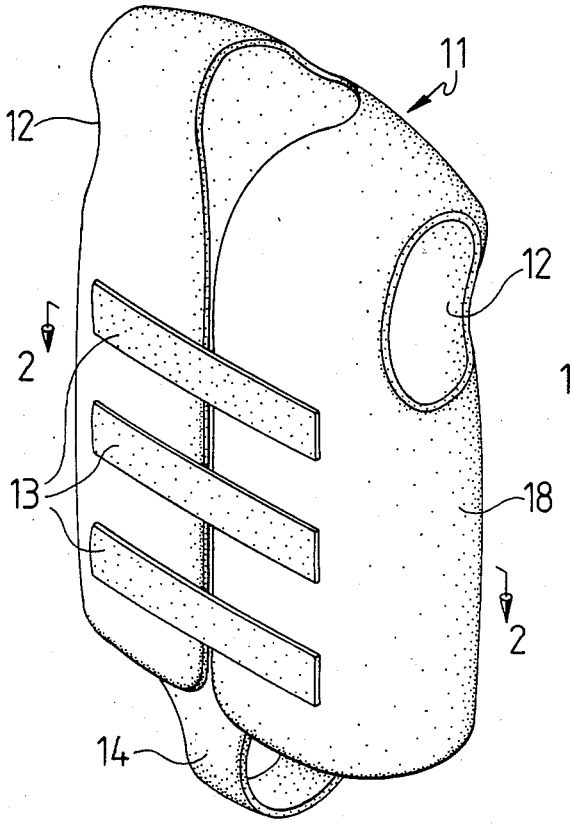
FIG. 1 is a perspective view of the hydrotherapy vest showing the front portion closed.

Referring to FIG. 1 it may be seen that my hydrotherapy vest utilizes a vest-like cover member 11 which extends over the shoulders and down below the arms of a user to the hipline. There are armholes 12 and suitable closure members 13 which may be hook and pile type closures or belt closures or any combination of other closures which are adjustable such that the vest-like member 11 may be adjusted in girth to fit snugly about the torso of the user. Attached to the rear of the vest and extending to the front of the vest is a crotch strap 14, also called a beaver tail, which extends between the legs of the user and fastens to the front of the vest 12 by suitable hook and pile type fasteners or other type fasteners. The crotch strap 14 should be of sufficient width as to disperse any load and forces created by the buoying effect of the hydrotherapy vest evenly in the region without discomfort.

Figure 2:
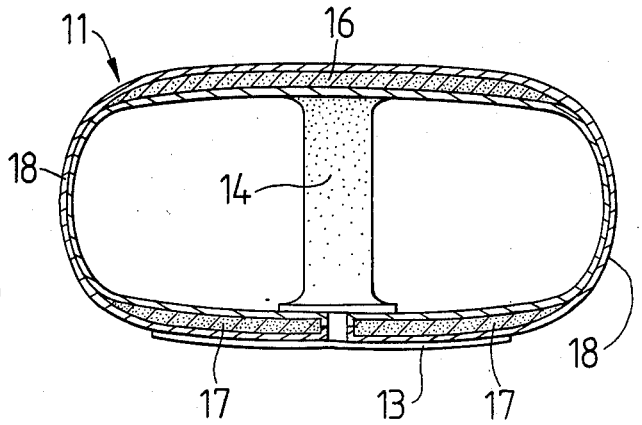
FIG. 2 is a sectional view taken along line 2—2 of FIG. 1 showing internal flotation elements; and, FIG. 3 is a pictorial rendition of a user wearing the hydrotherapy vest in water and supported at the proper angle for running.
Figure 3:
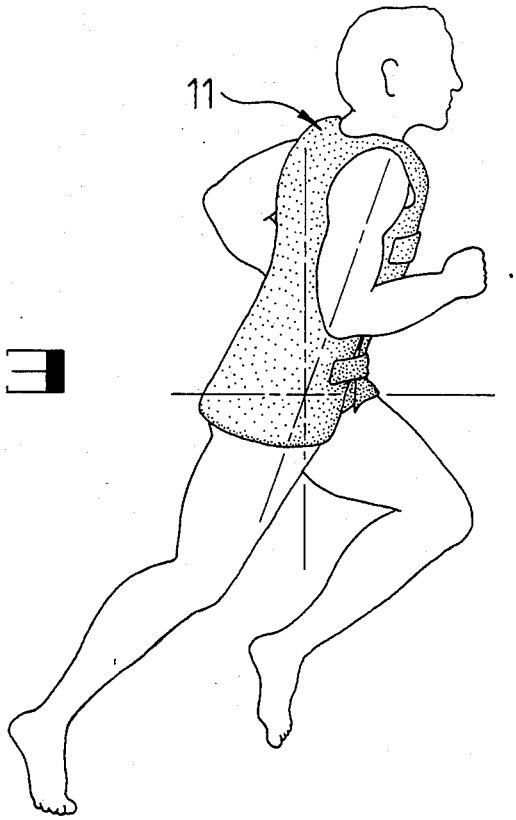

As may be seen in FIG. 2 the vest-like member 11 encloses suitable buoyant materials which give the hydrotherapy vest additional thickness in the forward and rear regions. A rear flotation element 16 is encased within the back of the vest-like member 11 and extends from the hipline of the user upwards to the shoulderline of the user and is a generally planar member of substantially uniform thickness which tapers outwardly toward the sides of the user. A forward or front flotation element 17 may be divided into a left half and right half and is spaced within the front of the vest-like member 11 and extends from the hipline upwards to the pectoral region of the user. Like the rear flotation element 16, the front flotation element 17 is a generally planar element of substantially uniform thickness which also tapers laterally toward the sides of the user. The taper of the thickness of the front and rear flotation elements 17 and 16 provides a lateral region 18 beneath the armholes 12 which is substantially thinner than the remainder of the vest, having a thickness of approximately 1/16th of an inch. The thinness of this lateral region 18 allows the user the unrestricted movement of his arms adjacent his torso thereby enabling the user to move his arms in a natural mechanical motion while performing most exercises. It will be appreciated, of course, that the crotch strap 14 must be sufficiently comfortable as to allow the user to exercise his legs in a natural biomechanical motion without chafing or other discomfort.

The flotation elements 16 and 17 provide buoyancy which supports the user in water, preferably the water is of a depth such that the user cannot touch bottom when supported by the hydrotherapy vest. To properly train the muscles by duplicating their biomechanical motions in water as opposed to on the track or the dancefloor, it is necessary that the user be supported in a manner which does not require him to overcome the effects of the support mechanism in order to perform the natural biomechanical motions. Therefore the flotation elements 16 and 17 are proportionately sized such that the rear flotation element 16 provides greater buoyant force than does the front flotation element 17 thereby causing the user to be supported in the water in an upright position which is slightly inclined forwardly of the vertical plane preferably at an angle of 10° to 30°. This allows a user who is training for running exercises, for example, to assume a natural forward inclination, which would be the same position utilized in running on a track, while in the water without having to overcome the effect of a flotation device which would inherently cause him to float on his back. It should be noted that contrary to conventional flotation devices which do cause the user to float on his back, the present device would constitute a hazard if used as a safety device and is therefore not considered to be a safety device but rather a training device. Additionally, for proper conditioning it is necessary that as much of the body as possible be immersed in the water, so that each muscle involved in a particular activity may benefit from the resistive forces encountered by motion through the water; therefore, the buoyant forces exerted by the combined front and rear elements is sufficient to support the user in the aforementioned upright position with only the head and part of the neck of the user extending above the waterline. That is to say, when property utilized the hydrotherapy vest allows the user to sink in the water to the extent that his shoulders are immersed, whereby the shoulder muscles and upper arms are subjected to the resistive forces of the water. It should therefore be abundantly clear that the present device is not intended as a substitute for conventional life preservers or ski vests which in fact hold the upper torso above the water line.

It should be clear from the above description of the position in which the hydrotherapy vest supports the user, that it is imperative that the vest fit properly; therefore the vest is to be made in a range of different sizes to fit the torso of the individual user and can be custom designed as necessary for athletes or users of particularly unusual sizes. Regardless of the size of the user, the hydrotherapy vest must be adjusted in girth by the closure members 13 and the crotch strap 14 must be adjusted such that the hydrotherapy vest does not ride up the torso of the user when in the water but rather remains in a substantially fixed position on the body.

In use, the user dons the hydrotherapy vest prior to entering the water and adjusts the closure members 13 and the crotch strap 14 for the proper fit prior to entering the water. The user then enters water of sufficient depth to prevent him from touching the bottom of the pool and proceeds with his exercise routine as he would on dry land, with the difference being that his muscular system is subjected to increased resistance due to the water having greater resistance than air and he encounters no traumatizing contact with a supporting surface as occurs in the case of running. For example, the musculo-skeletal structure of the foot may encounter a force of 800 pounds per foot strike when running; however this is reduced to zero pounds by the use of the hydrotherapy vest in deep water. Consequently, none of the deleterious effects of running or other physical exercise, such as aerobics or dance, which involve contact with a supporting surface are encountered in the use of the hydrotherapy vest. While these deleterious effects are removed, it should be noted that the positioning of the user in the water by the hydrotherapy vest enables the user to utilize the same muscles in the same manner as he would in normal training inasmuch as the hydrotherapy vest provides complete freedom of movement of the appendages and supports the user in a manner which does not require exertion of muscle groups to maintain the natural balance and position.

While I have shown my invention in but one form, it will be obvious to those skilled in the art that it is not so limited, but is susceptible of various changes and modifications without departing from the spirit thereof.

What I claim is:

1. Apparatus for use by a wearer in performing within a body of water exercise movements corresponding to a land-based running activity, comprising:

(a) flotation means substantially conforming to the torso of a wearer for supporting the wearer in water with his body submerged to a level above the shoulders said flotation means extending in front of and behind the wearer's body and being constructed so as to support him in a substantially upright position with a forward lean of less than approximately 30° from the vertical, said position corresponding to a body position assumed in a land-based running activity; and (b) restraining means for holding said flotation means snugly in position on said user during said exercise.

2. Apparatus as defined in claim 1 wherein said flotation means provides buoyant force proportional between the front and back of the user such that the user is supported at an angle of 10° to 30° forwardly of vertical.

3. Apparatus as described in claim 2 wherein said flotation means comprises a plurality generally planar buoyant members having a generally uniform thickness and extending from the hips of the user to the shoulder of the user along the front and back of the torso of the user.

4. Apparatus as defined in claim 1 further comprising a vest-like member encasing said flotation means and operably attached to said restraining means with said vest-like member being adjustable in girth.

5. Apparatus as defined in claim 4 wherein said restraining means comprises a strap extending between the user's legs and detachably affixed to said vest-like member.

6. Apparatus for use in performing within a body of water exercise movements corresponding to a land-based running activity comprising:

(a) a vest-like member worn by the user and extending from the shoulders of the user to the hips of the user;

(b) flotation means enclosed within said vest-like member for imparting a predetermined level of buoyancy to the user such that the user is supported in water with his body submerged to a point above the shoulders, said flotation means being constructed to exert a greater buoyant force on the rear of the user than the front of the user so as to support said user in an upright position inclined forwardly of vertical by less than approximately 30°, which position corresponds to that assumed in a land-based running activity; and (c) restraining means attached to said vest-like member for preventing longitudinal motion of said vest-like member along the torso of the said user.

7. Apparatus as defined in claim 6 wherein the buoyant force exerted by said flotation means is proportionally divided to support said user at a forward inclination between 10° and 30° from vertical.

8. Apparatus as defined in claim 6 wherein said vest-like member and said flotation means have a combined thickness of approximately one-sixteenth inch beneath the arms of the user, whereby the user is provided unrestricted arm motion adjacent the body of the user.

9. Apparatus as defined in claim 6 wherein said vest-like member is adjustable in girth to substantially conform to the torso of the user.

10. Apparatus as defined in claim 6 wherein said restraining means comprises a strap-like member extending between the legs of the user and detachably affixed to said vest.

11. Apparatus as defined in claim 6 wherein said flotation means comprises generally planar panels of buoyant material having a substantially uniform thickness and extending from the hips of the user upwards to the shoulders of the user.

12. Apparatus for use in performing within a body of water movements corresponding to a land-based running activity, comprising:

(a) a vest-like member extending from the shoulders of a user to the hips thereof and adapted to substantially conform to the torso of the user without restricting the movement of the user's arms or legs;

(b) a rear flotation element contained within said vest-like member and positioned along the back of the user;

(c) a front flotation element contained within said vest-like member and positioned along the front of the user, said front flotation element providing sufficiently less buoyant force than said rear flotation element so that the user is supported by said vest at an inclination forward of vertical of less than approximately 30°, said front and rear flotation elements having a combined buoyant force calculated to support the user with his body submerged in water to a level above the shoulders and in a generally upright position corresponding to the position assumed by the body in a land-based running activity; and (d) means passing between the legs of the user and attached to said vest for restraining said vest from upward motion along the torso of the user.

13. Apparatus as defined in claim 12 wherein said front and rear flotation elements support the user at an angle of between 10° and 30° forward of vertical.

14. Apparatus as defined in claim 12 wherein said vest includes side portions beneath the arms of said wearer with said side portion having a thickness of approximately one-sixteenth of an inch.

* * * * *